US005669526A

United States Patent [19]

Keyfauver

[11] Patent Number: 5,669,526

[45] Date of Patent: Sep. 23, 1997

[54] STACKABLE SPILL PROOF PAINT CAN

[76] Inventor: Terry L. Keyfauver, 1621 T St. NW. #806, Washington, D.C. 20009-3359

[21] Appl. No.: 625,576

[22] Filed: Mar. 28, 1996

[51] Int. Cl.[6] ..... B65D 25/40

[52] U.S. Cl. ..... 220/696; 206/508; 206/509; 222/569; 222/570

[58] Field of Search ..... 220/695, 696, 220/354; 206/508, 821, 509; 222/566, 567, 569, 570

[56] References Cited

U.S. PATENT DOCUMENTS

| | | | |
|---|---|---|---|
| 2,418,502 | 4/1947 | Ferguson | 220/354 |
| 3,672,547 | 6/1972 | Kozlowski | 220/354 |
| 3,980,213 | 9/1976 | Ramsay | 222/570 |
| 4,428,498 | 1/1984 | Obey | 206/508 |
| 4,452,381 | 6/1984 | Freeman | 222/566 |
| 4,893,723 | 1/1990 | Seabolt | 220/695 |
| 4,949,884 | 8/1990 | Dahl | 322/570 |
| 5,031,804 | 7/1991 | Conrad | 222/566 |
| 5,368,389 | 11/1994 | Dedoes | 366/247 |
| 5,388,715 | 2/1995 | Schwindt | 220/354 |

*Primary Examiner*—Stephen J. Castellano
*Attorney, Agent, or Firm*—Richard L. Miller, P.E.

[57] ABSTRACT

A stackable spill proof paint that includes a hollow and generally cylindrically-shaped container, a generally circular-shaped lid, and a pouring spout. The top of the hollow and generally cylindrically-shaped container has a through aperture with a shape and a ledge, so that excess paint can be wiped off from a paint brush that was previously dipped into paint contained in the hollow and generally cylindrically-shaped container. The generally circular-shaped lid has a depression with through aperture, and a shape substantially equivalent to the shape of the through aperture of the hollow and generally cylindrically-shaped container, so that when the generally circular-shaped lid is placed on the hollow and generally cylindrically-shaped container the depression of the generally circular-shaped lid enters the through aperture of the hollow and generally cylindrically-shaped container and prevents relative rotation therebetween while providing a seal therebetween. The pouring spout is disposed in the depression of the generally circular-shaped lid and is in fluid communication with the through aperture of the depression of the generally circular-shaped lid, so that the paint contained in the hollow and generally cylindrically-shaped container can be readily poured therefrom.

15 Claims, 1 Drawing Sheet

STACKABLE SPILL PROOF PAINT CAN

BACKGROUND OF THE INVENTION

The present invention relates to a spill proof paint can. More particularly, the present invention relates to a stackable spill proof paint can that includes a hollow, partially opened-top, closed-bottom, and generally cylindrically-shaped container having a top with a specifically configured through aperture, a removable, resealable, and generally circular-shaped lid having a specifically configured depression that generally matches the specifically configured through aperture of the top of the hollow, partially opened-top, closed-bottom, and generally cylindrically-shaped container for preventing relative rotation therebetween, and a pouring spout disposed on the removable, resealable, and generally circular-shaped lid for emptying the contents of the hollow, partially opened-top, closed-bottom, and generally cylindrically-shaped container.

Conventional containers for viscous liquids, such as paints, enamels and the like, usually includes a flat top having a circular bead formed around the outer edge thereof for engagement with a circular groove surrounding the upper part of the container. These cans are generally of great diameter and pouring the viscous contents therefrom causes the liquid to spread out over a wide pouring area about the circumference of the container often causing spilling of the contents onto surfaces not intended to be wet with the liquid.

Additionally, when the container is opened, the whole top of the container becomes exposed to the air allowing dust and dirt to enter into the container and contact the viscous contents therein such that later application of the contents to a surface would show dirt particles and other discontinuities that distract from the quality of the material. Further, continually removing the lid and pouring the paint or other viscous liquid therefrom causes the liquid to build up in the groove of the container and discolor, dry, flake, and chip and fall into the liquid remaining in the container.

A number of attempts have been made in the past to provide a narrow pouring spout for attachment to either the container or an aperture formed in the flat lid to confine the liquid poring from the container into a narrow and more controllable stream. These devices, however, posses their own special problems.

For instance, some of the spouts are so large they encompass the whole top of the viscous liquid container and therefore do not confine the contents thereof sufficient to make the stream any more controllable than the fully opened container. Other spouts contain particular attachment features that require the attachment to be made at the factory or to be made to the lid using special equipment that is costly and not always available to the user. Most of the prior art spouts are of metal and difficult to clean.

For paint that is stored in containers already having a spout attached to the lid, the retailer finds he or she cannot stack the containers one on top of another as is usual with cans having flat tops because of the presence of the spout thereby forcing the seller to use a greater portion of the floor or storage area than he normally would have with other conventional containers.

Mechanical connections between the spouts and the container lid have been known to work loose thereby allowing the contents to flow through the loosened connections and spill onto floors and other surfaces. Some spouts contain air passageways or other interior piping that clogs with paint and prevents the spout from being later used with other materials—or cannot be easily cleaned so as to allow use with more than one material.

Most spouts in the prior art are designed such that they cannot withstand shock loading such as that coming from impacts from other containers that are moved about by the painter or user during normal painting utilization procedures.

Finally, slight dents made in the flat container lid by the accidental dropping of a hammer or bumping of the container, in many cases causes the spout to either be twisted into a non-usable position or to develop a leak, crack or otherwise become useless for confining the flow of the liquids from the container.

Numerous innovations for paint can lids have been provided in the prior art that will be described. Even though these innovations may be suitable for the specific individual purposes to which they address, however, they differ from the present invention in that they do not teach a stackable spill proof paint can that includes a hollow, partially opened-top, closed-bottom, and generally cylindrically-shaped container having a top with a specifically configured through aperture, a removable, resealable, and generally circular-shaped lid having a specifically configured depression that generally matches the specifically configured through aperture of the top of the hollow, partially opened-top, closed-bottom, and generally cylindrically-shaped container for preventing relative rotation therebetween, and a pouring spout disposed on the removable, resealable, and generally circular-shaped lid for emptying the contents of the hollow, partially opened-top, closed-bottom, and generally cylindrically-shaped container.

FOR EXAMPLE, U.S. Pat. No. 4,949,884 to Dahl teaches a paint can lid that includes a one-piece molded plastic lid having a periphery formed with an outer edge that engages the underside of a paint can rim, engages and extends up along the outer vertical edge of the paint can rim, and extends inwardly along the top of the paint can rim. The paint can lid further includes a frusto-conical-shaped pouring spout.

ANOTHER EXAMPLE, U.S. Pat. No. 5,031,804 to Conrad teaches a paint can lid that includes a short, conically-shaped pouring spout having a narrow diameter upper end and a wider diameter lower end so as to allow it to pass upward through an aperture formed in the flat lid for flexible engagement therewith.

STILL ANOTHER EXAMPLE, U.S. Pat. No. 5,368,389 to Dedoes teaches a paint can cover assembly that includes a lid, a spout attached along one side of the lid, a closure selectively opens and closes the spout, locking tabs detachably lock the lid across the top of a paint can, and a paint stir extends downwardly from the lid.

FINALLY, YET ANOTHER EXAMPLE, U.S. Pat. No. 5,388,715 to Schwindt teaches a spill proof paint lid that includes a central circular plate with a downwardly-extending peripheral extent and an interior ring. A pouring spout extends upwardly from the circular plate adjacent to the interior ring and a stirring slot is formed in the circular plate.

It is apparent that numerous innovations for paint can lids have been provided in the prior art that are adapted to be used. Furthermore, even though these innovations may be suitable for the specific individual purposes to which they address, they would not be suitable for the purposes of the present invention as heretofore described.

SUMMARY OF THE INVENTION

ACCORDINGLY, AN OBJECT of the present invention is to provide a stackable spill proof paint can that avoids the disadvantages of the prior art.

ANOTHER OBJECT of the present invention is to provide a stackable spill proof paint can that is simple and inexpensive to manufacture.

STILL ANOTHER OBJECT of the present invention is to provide a stackable spill proof paint can that is simple to use.

YET ANOTHER OBJECT of the present invention is to provide a stackable spill proof paint can that prevents liquids being poured therefrom from being spread out over a wide pouring area about the circumference of the container.

STILL YET ANOTHER OBJECT of the present invention is to provide a stackable spill proof paint can that will not spill the contents onto surfaces not intended to be wetted by the liquid.

YET STILL ANOTHER OBJECT of the present invention is to provide a stackable spill proof paint can that prevents dust and dirt from entering into the container and contacting the viscous contents therein.

STILL YET ANOTHER OBJECT of the present invention is to provide a stackable spill proof paint can that prevents application of the contents to a surface from showing dirt particles and other discontinuities that distract from the quality of the material.

YET STILL ANOTHER OBJECT of the present invention is to provide a stackable spill proof paint can that prevents liquid from building up in the groove of the container and discolor, dry, flake, and chip and fall into the liquid remaining in the container caused by the repeated removal of lid and the pouring of the paint or other viscous liquid therefrom.

STILL YET ANOTHER OBJECT of the present invention is to provide a stackable spill proof paint can whose pouring spout is small and does not encompass the whole top of the viscous liquid container and therefore confines the contents thereof sufficiently to make the stream more controllable than a fully opened container.

YET STILL ANOTHER OBJECT of the present invention is to provide a stackable spill proof paint can that is simple to clean and is recyclable.

STILL YET ANOTHER OBJECT of the present invention is to provide a stackable spill proof paint can that can be stacked and save storage space.

YET STILL ANOTHER OBJECT of the present invention is to provide a stackable spill proof paint can whose pouring spout will not work loose from the lid and thereby prevent the contents flowing therethrough from spilling onto floors and other surfaces.

STILL YET ANOTHER OBJECT of the present invention is to provide a stackable spill proof paint can that can be used with a wide variety of viscous liquids.

YET STILL ANOTHER OBJECT of the present invention is to provide a stackable spill proof paint can whose pouring spout can withstand stand shock loading such as that coming from impacts from other containers that are moved about by the painter or user during normal painting utilization procedures.

STILL YET ANOTHER OBJECT of the present invention is to provide a stackable spill proof paint can whose pouring spout will not be twisted into a non-usable position or develop a leak, crack or otherwise become useless for confining the flow of the liquids from the container when slight dents are made in the flat container lid by the accidental dropping of a hammer or bumping of another container.

YET STILL ANOTHER OBJECT of the present invention is to provide a stackable spill proof paint can that has less mess from paint drips and runs.

BRIEFLY STATED, STILL YET ANOTHER OBJECT of the present invention is to provide a stackable spill proof paint can that includes a hollow, partially opened-top, closed-bottom, and generally cylindrically-shaped container, a removable, resealable, and generally circular-shaped lid, and a pouring spout.

YET STILL ANOTHER OBJECT of the present invention is to provide a stackable spill proof paint can wherein the hollow, partially opened-top, closed-bottom, and generally cylindrically-shaped container has a partially opened-top with a perimeter and an outer surface, and a closed bottom.

STILL YET ANOTHER OBJECT of the present invention is to provide a stackable spill proof paint can wherein the partially opened-top of the hollow, partially opened-top, closed-bottom, and generally cylindrically-shaped container has a through aperture with a shape, and a ledge, so that excess paint can be wiped off from a paint brush that was previously dipped into paint contained in the hollow, partially opened-top, closed-bottom, and generally cylindrically-shaped container.

YET STILL ANOTHER OBJECT of the present invention is to provide a stackable spill proof paint can wherein the removable, resealable, and generally circular-shaped lid has a generally circular-shaped main portion with a perimeter and a depression.

STILL YET ANOTHER OBJECT of the present invention is to provide a stackable spill proof paint can wherein the depression of the generally circular-shaped main portion of the removable, resealable, and generally circular-shaped lid has a depth, a through aperture, and a shape substantially equivalent to the shape of the through aperture of the partially opened-top of the hollow, partially opened-top, closed-bottom, and generally cylindrically-shaped container, so that when the removable, resealable, and generally circular-shaped lid is placed on the partially opened-top of the hollow, partially opened-top, closed-bottom, and generally cylindrically-shaped container the depression of the generally circular-shaped main portion of the removable, resealable, and generally circular-shaped lid enters the through aperture of the partially opened-top of the hollow, partially opened-top, closed-bottom, and generally cylindrically-shaped container and prevents relative rotation between said removable, resealable, and generally circular-shaped lid and said hollow, partially opened-top, closed-bottom, and generally cylindrically-shaped container while providing a seal therebetween.

YET STILL ANOTHER OBJECT of the present invention is to provide a stackable spill proof paint can wherein the pouring spout is disposed in the depression of the generally circular-shaped main portion of the removable, resealable, and generally circular-shaped lid and is in fluid communication with the through aperture of the depression of the generally circular-shaped main portion of the removable, resealable, and generally circular-shaped lid, so that the paint contained in the hollow, partially opened-top, closed-bottom, and generally cylindrically-shaped container can be readily poured therefrom.

STILL YET ANOTHER OBJECT of the present invention is to provide a stackable spill proof paint can wherein the hollow, partially opened-top, closed-bottom, and generally cylindrically-shaped container, the removable, resealable, and generally circular-shaped lid, and the pouring spout are plastic, so that they will not rust during storage of left over paint and the removable, resealable, and generally circular-shaped lid can be used to mix paint colors.

YET STILL ANOTHER OBJECT of the present invention is to provide a stackable spill proof paint can wherein the through aperture of the partially opened-top of the hollow, partially opened-top, closed-bottom, and generally cylindrically-shaped container is a substantially D-shaped through aperture with a straight side and an arcuate side.

STILL YET ANOTHER OBJECT of the present invention is to provide a stackable spill proof paint can wherein the ledge of the partially opened-top of the hollow, partially opened-top, closed-bottom, and generally cylindrically-shaped container is a substantially D-shaped ledge formed by the straight side of the substantially D-shaped through aperture of the partially opened-top of the hollow, partially opened-top, closed-bottom, and generally cylindrically-shaped container and an intersecting part of the perimeter of the partially opened-top of the hollow, partially opened-top, closed-bottom, and generally cylindrically-shaped container.

YET STILL ANOTHER OBJECT of the present invention is to provide a stackable spill proof paint can that further includes a circumferencially-disposed and upwardly-extending bead that surrounds and extends upwardly from the perimeter of the partially opened-top of the partially opened-top, closed-bottom, and generally cylindrically-shaped container, so that yet an additional seal is provided between the removable, resealable, and generally circular-shaped lid and the partially opened-top, closed-bottom, and generally cylindrically-shaped container.

STILL YET ANOTHER OBJECT of the present invention is to provide a stackable spill proof paint can that further includes a pivotally mounted and substantially semi-circular-shaped carrying handle with ends that are pivotally mounted to the partially opened-top, closed-bottom, and generally cylindrically-shaped container, so that carrying the stackable spill proof paint can is facilitated.

YET STILL ANOTHER OBJECT of the present invention is to provide a stackable spill proof paint can wherein the removable, resealable, and generally circular-shaped lid further has an upwardly-and-downwardly-extending and circumferencially-disposed rim the extends upwardly and downwardly from the perimeter of the generally circular-shaped main portion of the removable, resealable, and generally circular-shaped lid.

STILL YET ANOTHER OBJECT of the present invention is to provide a stackable spill proof paint can wherein the upwardly-and-downwardly-extending and circumferencially-disposed rim of the removable, resealable, and generally circular-shaped lid has an upwardly-extending and circumferencially-disposed portion that extends upwardly from the perimeter of the generally circular-shaped main portion of the removable, resealable, and generally circular-shaped lid and together with the generally circular-shaped main portion of the removable, resealable, and generally circular-shaped lid forms a receptacle, so that the closed bottom of the hollow, partially opened-top, closed-bottom, and generally cylindrically-shaped container of a second stackable spill proof paint can be positioned in the receptacle of the removable, resealable, and generally circular-shaped lid of a first stackable spill proof paint can with the upwardly-extending and circumferencially-disposed portion of the upwardly-and-downwardly-extending and circumferencially-disposed rim of the removable, resealable, and generally circular-shaped lid of the first stackable spill proof paint can preventing lateral movement of the second stackable spill proof paint can.

YET STILL ANOTHER OBJECT of the present invention is to provide a stackable spill proof paint can wherein the upwardly-and-downwardly-extending and circumferencially-disposed rim of the removable, resealable, and generally circular-shaped lid further has a downwardly-extending and circumferencially-disposed portion that extends downwardly from the perimeter of the generally circular-shaped main portion of the removable, resealable, and generally circular-shaped lid and is in substantial alignment with the upwardly-extending and circumferencially-disposed portion of the upwardly-and-downwardly-extending and circumferencially-disposed rim of the removable, resealable, and generally circular-shaped lid and is positioned adjacent to the outer surface of the perimeter of the partially opened-top of the hollow, partially opened-top, closed-bottom, and generally cylindrically-shaped container, so that yet an additional seal is provided between the removable, resealable, and generally circular-shaped lid and the partially opened-top, closed-bottom, and generally cylindrically-shaped container.

STILL YET ANOTHER OBJECT of the present invention is to provide a stackable spill proof paint can wherein the depression of the generally circular-shaped main portion of the removable, resealable, and generally circular-shaped lid is a substantially D-shaped and downwardly-extending depression.

YET STILL ANOTHER OBJECT of the present invention is to provide a stackable spill proof paint can wherein the D-shaped and downwardly-extending depression of the generally circular-shaped main portion of the removable, resealable, and generally circular-shaped lid has a straight side and an arcuate side with a substantial midpoint.

STILL YET ANOTHER OBJECT of the present invention is to provide a stackable spill proof paint can wherein the arcuate side of the substantially D-shaped and downwardly-extending depression of the generally circular-shaped main portion of the removable, resealable, and generally circular-shaped lid is substantially parallel to and disposed slightly inward of the perimeter of the generally circular-shaped main portion of the removable, resealable, and generally circular-shaped lid.

YET STILL ANOTHER OBJECT of the present invention is to provide a stackable spill proof paint can wherein the substantially D-shaped and downwardly-extending depression of the generally circular-shaped main portion of the removable, resealable, and generally circular-shaped lid has a through aperture.

STILL YET ANOTHER OBJECT of the present invention is to provide a stackable spill proof paint can wherein the through aperture of the substantially D-shaped and downwardly-extending depression of the generally circular-shaped main portion of the removable, resealable, and generally circular-shaped lid is disposed slightly inward of the substantial midpoint of the arcuate side of the substantially D-shaped and downwardly-extending depression of the generally circular-shaped main portion of the removable, resealable, and generally circular-shaped lid and in proximity to the perimeter of the generally circular-shaped main portion of the removable, resealable, and generally circular-shaped lid.

YET STILL ANOTHER OBJECT of the present invention is to provide a stackable spill proof paint can wherein the pouring spout is a bellowed, collapsible, and pop-up pouring spout that has an open narrow free distal end and an open wide proximal end that is wider than the open narrow free distal end of the bellowed, collapsible, and pop-up pouring spout and is sealing secured in the aperture of the substantially D-shaped and downwardly-extending depression of the generally circular-shaped main portion of the removable, resealable, and generally circular-shaped lid while being in fluid communication therewith.

STILL YET ANOTHER OBJECT of the present invention is to provide a stackable spill proof paint can wherein the bellowed, collapsible, and pop-up pouring spout is collapsible to a height no greater than the depth of the depression of the generally circular-shaped main portion of the removable, resealable, and generally circular-shaped lid, so that when the bellowed, collapsible, and pop-up pouring spout is collapsed into the depression of the generally circular-shaped main portion of the removable, resealable, and generally circular-shaped lid, the closed bottom of the hollow, partially opened-top, closed-bottom, and generally cylindrically-shaped container of a second stackable spill proof paint can be positioned on the removable, resealable, and generally circular-shaped lid of a first stackable spill proof paint can.

YET STILL ANOTHER OBJECT of the present invention is to provide a stackable spill proof paint can that further includes a cap for selectively opening and closing the open narrow free distal end of the bellowed, collapsible, and pop-up pouring spout.

STILL YET ANOTHER OBJECT of the present invention is to provide a method of closing a stackable spill proof paint can that includes the step of placing a removable, resealable, and generally circular-shaped lid of the stackable spill proof paint can onto a partially opened-top of a hollow, partially opened-top, closed-bottom, and generally cylindrically-shaped container of the stackable spill proof paint can with a substantially D-shaped and downwardly-extending depression of a generally circular-shaped main portion of the removable, resealable, and generally circular-shaped lid entering a substantially D-shaped through aperture of the partially opened-top of the hollow, partially opened-top, closed-bottom, and generally cylindrically-shaped container with a straight side of the substantially D-shaped and downwardly-extending depression of the generally circular-shaped main portion of the removable, resealable, and generally circular-shaped lid being in general alignment with a straight side of the substantially D-shaped through aperture of the partially opened-top of the hollow, partially opened-top, closed-bottom, and generally cylindrically-shaped container, so that relative rotation between said removable, resealable, and generally circular-shaped and said hollow, partially opened-top, closed-bottom, and generally cylindrically-shaped container is prevented while providing a seal therebetween.

STILL YET ANOTHER OBJECT of the present invention is to provide a method of stacking a second stackable spill proof paint can on a first stackable spill proof paint can that includes the steps of collapsing a bellowed, collapsible, and pop-up pouring spout of the first stackable spill proof paint can into a substantially D-shaped and downwardly-extending depression of a generally circular-shaped main portion of a removable, resealable, and generally circular-shaped lid of the first stackable spill proof paint can, and positioning a closed bottom of a partially opened-top of a hollow, partially opened-top, closed-bottom, and generally cylindrically-shaped container of the second stackable spill proof paint can in a receptacle of the removable, resealable, and generally circular-shaped lid of the first stackable spill proof paint can which is defined by an upwardly-extending and circumferencially-disposed portion of an upwardly-and-downwardly-extending and circumferencially-disposed rim of a perimeter of the removable, resealable, and generally circular-shaped lid of the first stackable spill proof paint can, so that lateral movement of the second stackable spill proof paint can is prevented.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows.

LIST OF REFERENCE NUMERALS UTILIZED IN THE DRAWING

Figure 1:
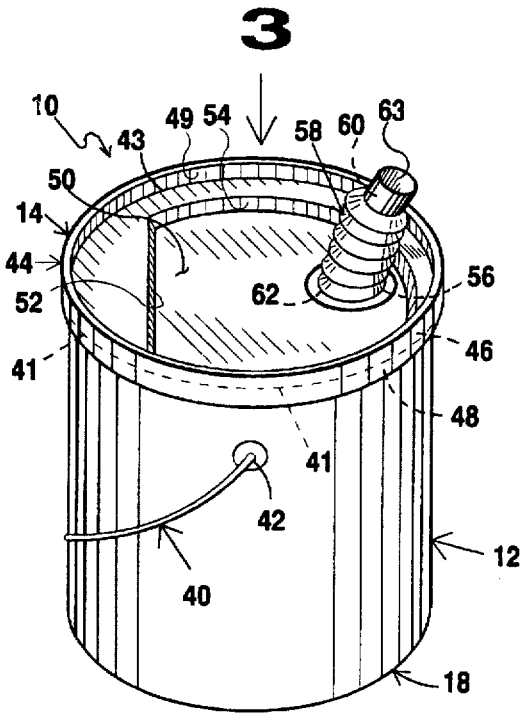
FIG. 1 is a diagrammatic perspective view of the present invention.

10 stackable spill proof paint can of the present invention
12 hollow, partially opened-top, closed-bottom, and generally cylindrically-shaped container
14 removable, resealable, and generally circular-shaped lid
16 container partially opened-top
18 container closed bottom
20 container top perimeter
22 container top substantially D-shaped through aperture
24 container top substantially D-shaped through aperture straight side
26 container top substantially D-shaped through aperture arcuate side
28 container top substantially D-shaped ledge
30 excess paint
32 paint brush
34 user hand
36 paint
38 container top circumferencially-disposed and upwardly-extending bead
40 pivotally mounted and substantially semi-circular-shaped easy carrying handle
42 carrying handle ends
41 lid generally circular-shaped main portion
42 lid main portion perimeter
44 lid perimeter upwardly-and-downwardly-extending and circumferencially-disposed rim
46 lid perimeter rim upwardly-extending and circumferencially-disposed portion
48 lid perimeter rim downwardly-extending and circumferencially-disposed portion
49 can stacking lid receptacle
50 lid main portion substantially D-shaped and downwardly-extending depression
52 lid main portion substantially D-shaped depression straight side
54 lid main portion substantially D-shaped depression arcuate side
56 lid main portion depression through aperture 58 easy pour, bellowed, collapsible, and pop-up poring spout
60 spout open narrow free distal end
62 spout open wide proximal end
63 spout open narrow free distal end removable cap
64 lid main portion depression depth

DETAILED DESCRIPTION OF THE PREFERRED EMBODIMENT

Referring now to the figures in which like numerals indicate like parts, and particularly to FIG. 1, the stackable spill proof paint can of the present invention is shown generally at 10 and includes a hollow, partially opened-top, closed-bottom, and generally cylindrically-shaped container 12 and a removable, resealable, and generally circular-shaped lid 14.

Figure 2:
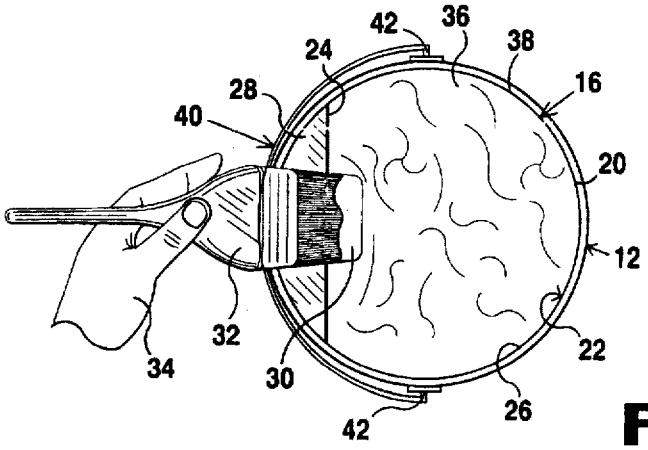
FIG. 2 is a diagrammatic top plan view of the container with the lid removed and the ledge being used to scrape off excess paint from a brush.

The specific configuration of the hollow, partially opened-top, closed-bottom, and generally cylindrically-shaped container 12 can best be seen in FIGS. 1 and 2, and as such, will be discussed with reference thereto.

The hollow, partially opened-top, closed-bottom, and generally cylindrically-shaped container 12 has a container partially opened-top 16 with container top perimeter 20 and a container closed bottom 18, and is preferably strong recyclable plastic and of a one gallon size, so that the hollow, partially opened-top, closed-bottom, and generally cylindrically-shaped container 12 will not rust during storage of left over paint contained therein.

The container partially opened-top 16 of the hollow, partially opened-top, closed-bottom, and generally cylindrically-shaped container 12 has a container top substantially D-shaped through aperture 22 with a container top substantially D-shaped through aperture straight side 24 and a container top substantially D-shaped through aperture arcuate side 26.

The container top substantially D-shaped through aperture straight side 24 of the container top substantially D-shaped through aperture 22 of the container partially opened-top 16 of the hollow, partially opened-top, closed-bottom, and generally cylindrically-shaped container 12 forms with the container top perimeter 20 of the container partially opened-top 16 of the hollow, partially opened-top, closed-bottom, and generally cylindrically-shaped container 12 a container top substantially D-shaped ledge 28.

The container top substantially D-shaped ledge 28 of the container partially opened-top 16 of the hollow, partially opened-top, closed-bottom, and generally cylindrically-shaped container 12 is used to wipe off excess paint 30 from a paint brush 32 being held by a user hand 34 and which was previously dipped into paint 36 contained in the hollow, partially opened-top, closed-bottom, and generally cylindrically-shaped container 12, as shown in figure.

The partially opened-top, closed-bottom, and generally cylindrically-shaped container 12 further has a container top circumferencially-disposed and upwardly-extending bead 38 that surrounds the container top perimeter 20 of the container partially opened-top 16 of the partially opened-top, closed-bottom, and generally cylindrically-shaped container 12.

The partially opened-top, closed-bottom, and generally cylindrically-shaped container 12 further has a pivotally mounted and substantially semi-circular-shaped easy carrying handle 40, preferably of plastic, with carrying handle ends 42 that are pivotally mounted to the partially opened-top, closed-bottom, and generally cylindrically-shaped container 12, so that carrying the stackable spill proof paint can 10 is facilitated.

Figure 3:
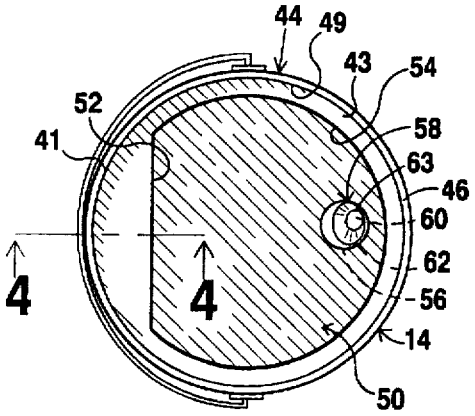
FIG. 3 is a diagrammatic top plan view taken in the direction of arrow 3 in FIG. 1.
Figure 4:
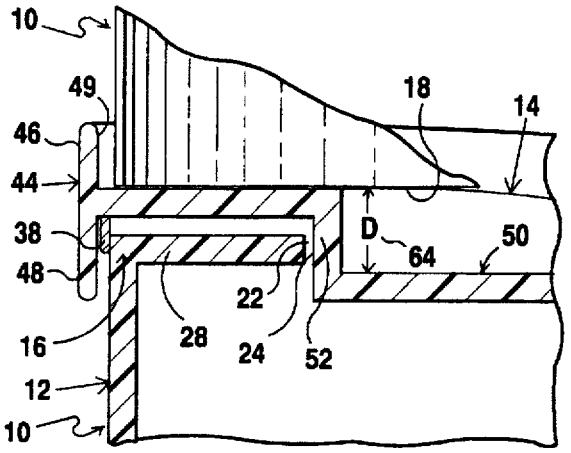
FIG. 4 is an enlarged cross sectional view, with parts broken away, taken on line 4—4 in FIG. 3.

The specific configuration of the removable, resealable, and generally circular-shaped lid 14 can best be seen in FIGS. 1, 3 and 4, and as such, will be discussed with reference thereto.

The removable, resealable, and generally circular-shaped lid 14 has a lid generally circular-shaped main portion 41 with a lid main portion perimeter 42 and a lid perimeter upwardly-and-downwardly-extending and circumferencially-disposed rim 44.

The removable, resealable, and generally circular-shaped lid 14 is preferably recyclable plastic that is removable and resealable, so that the removable, resealable, and generally circular-shaped lid 14 can be used to mix paint colors and will not rust during storage of left paint left thereon.

The lid perimeter upwardly-and-downwardly-extending and circumferencially-disposed rim 44 of the removable, resealable, and generally circular-shaped lid 14 has a lid perimeter rim upwardly-extending and circumferencially-disposed portion 46 that extends upwardly from the lid main portion perimeter 42 of the lid generally circular-shaped main portion 41 of the removable, resealable, and generally circular-shaped lid 14 and a lid perimeter rim downwardly-extending and circumferencially-disposed portion 48 that extends downwardly from the lid main portion perimeter 42 of the lid generally circular-shaped main portion 41 of the removable, resealable, and generally circular-shaped lid 14 and is in substantial alignment with the lid perimeter rim upwardly-extending and circumferencially-disposed portion 46 of the lid perimeter upwardly-and-downwardly-extending and circumferencially-disposed rim 44 of the removable, resealable, and generally circular-shaped lid 14.

The lid perimeter rim upwardly-extending and circumferencially-disposed portion 46 of the lid perimeter upwardly-and-downwardly-extending and circumferencially-disposed rim 44 of the removable, resealable, and generally circular-shaped lid 14 together with the lid generally circular-shaped main portion 41 of the removable, resealable, and generally circular-shaped lid 14 define a can stacking lid receptacle 49.

The lid generally circular-shaped main portion 41 of the removable, resealable, and generally circular-shaped lid 14 has a lid main portion substantially D-shaped and downwardly-extending depression 50 that extends downwardly from the lid generally circular-shaped main portion 41 of the removable, resealable, and generally circular-shaped lid 14. The lid main portion substantially D-shaped and downwardly-extending depression 50 of the lid generally circular-shaped main portion 41 of the removable, resealable, and generally circular-shaped lid 14 has a lid main portion substantially D-shaped depression straight side 52 and a lid main portion substantially D-shaped depression arcuate side 54.

The lid main portion substantially D-shaped depression arcuate side 54 of the lid main portion substantially D-shaped and downwardly-extending depression 50 of the lid generally circular-shaped main portion 41 of the removable, resealable, and generally circular-shaped lid 14 is substantially parallel to, and disposed slightly inward of, the lid main portion perimeter 42 of the lid generally circular-shaped main portion 41 of the removable, resealable, and generally circular-shaped lid 14.

The lid main portion substantially D-shaped and downwardly-extending depression 50 of the lid generally circular-shaped main portion 41 of the removable, resealable, and generally circular-shaped lid 14 has a lid main portion depression through aperture 56 that is preferably disposed slightly inward of the substantial midpoint of the lid main portion substantially D-shaped depression arcuate side 54 of the lid main portion substantially D-shaped and downwardly-extending depression 50 of the lid generally circular-shaped main portion 41 of the removable, resealable, and generally circular-shaped lid 14 in proximity to the lid main portion perimeter 42 of the lid generally circular-shaped main portion 41 of the removable, resealable, and generally circular-shaped lid 14.

The removable, resealable, and generally circular-shaped lid 14 further has a easy pour, bellowed, collapsible, and pop-up pouring spout 58 that has a spout open narrow free distal end 60 and a spout open wide proximal end 62 that is wider than the spout open narrow free distal end 60 of the easy pour, bellowed, collapsible, and pop-up pouring spout 58 and is sealing secured in the lid main part depression through aperture 56 of the lid main portion substantially D-shaped and downwardly-extending depression 50 of the lid generally circular-shaped main portion 41 of the removable, resealable, and generally circular-shaped lid 14 and is in fluid communication therewith.

The easy pour, bellowed, collapsible, and pop-up pouring spout 58 of the removable, resealable, and generally circular-shaped lid 14 facilitates pouring the contents of the stackable spill proof paint can 10 into a paint pan (not shown) and whose spout open narrow free distal end 60 of the easy pour, bellowed, collapsible, and pop-up pouring spout 58 of the removable, resealable, and generally circular-shaped lid 14 can be closed by the use of a spout open narrow free distal end removable cap 63.

The easy pour, bellowed, collapsible, and pop-up pouring spout 58 is collapsible to a height no greater than a lid main portion depression depth 64 of the lid main portion substantially D-shaped and downwardly-extending depression 50 of the lid generally circular-shaped main portion 41 of the removable, resealable, and generally circular-shaped lid 14, so that when the easy pour, bellowed, collapsible, and pop-up pouring spout 58 is collapsed into the lid main portion depression through aperture 56 of the lid main portion substantially D-shaped and downwardly-extending depression 50 of the lid generally circular-shaped main portion 41 of the removable, resealable, and generally circular-shaped lid 14, another stackable spill proof paint can 10 can be stacked on the removable, resealable, and generally circular-shaped lid 14 of the stackable spill proof paint can 10.

The placement of the removable, resealable, and generally circular-shaped lid 14 on the hollow, partially opened-top, closed-bottom, and generally cylindrically-shaped container 12 and the stacking of a second stackable spill proof paint can 10 on a first stackable spill proof paint can 10 can best be seen in FIG. 4, and as such, will be discussed with reference thereto.

The removable, resealable, and generally circular-shaped lid 14 is snapped tight onto the container partially opened-top 16 of the hollow, partially opened-top, closed-bottom, and generally cylindrically-shaped container 12 with the lid main portion substantially D-shaped and downwardly-extending depression 50 of the lid generally circular-shaped main portion 41 of the removable, resealable, and generally circular-shaped lid 14 entering the container top substantially D-shaped through aperture 22 of the container partially opened-top 16 of the hollow, partially opened-top, closed-bottom, and generally cylindrically-shaped container 12 and with the lid main portion substantially D-shaped depression straight side 52 of the lid main portion substantially D-shaped and downwardly-extending depression 50 of the lid generally circular-shaped main portion 41 of the removable, resealable, and generally circular-shaped lid 14 being in general alignment with the container top substantially D-shaped through aperture straight side 24 of the container top substantially D-shaped through aperture 22 of the container partially opened-top 16 of the hollow, partially opened-top, closed-bottom, and generally cylindrically-shaped container 12, so that the removable, resealable, and generally circular-shaped lid 14 can not rotate relative to the hollow, partially opened-top, closed-bottom, and generally cylindrically-shaped container 12 and provide a better seal.

The lid perimeter rim downwardly-extending and circumferencially-disposed portion 48 of the lid perimeter upwardly-and-downwardly-extending and circumferencially-disposed rim 44 of the removable, resealable, and generally circular-shaped lid 14 contacts the outer surface of the container partially opened-top 16 of the hollow, partially opened-top, closed-bottom, and generally cylindrically-shaped container 12 with the container top circumferencially-disposed and upwardly-extending bead 38 of the container top perimeter 20 of the container partially opened-top 16 of the partially opened-top, closed-bottom, and generally cylindrically-shaped container 12 forming yet an additional seal therebetween.

To stack the second stackable spill proof paint can 10 atop the first stackable spill proof paint can 10, the easy pour, bellowed, collapsible, and pop-up pouring spout 58 is retracted into the lid main portion substantially D-shaped and downwardly-extending depression 50 of the lid generally circular-shaped main portion 41 of the removable, resealable, and generally circular-shaped lid 14 of the first stackable spill proof paint can 10.

The container closed bottom 18 of the hollow, partially opened-top, closed-bottom, and generally cylindrically-shaped container 12 of the second stackable spill proof paint can 10 is positioned in the can stacking lid receptacle 49 of the removable, resealable, and generally circular-shaped lid 14 of the first stackable spill proof paint can 10 with the lid perimeter rim upwardly-extending and circumferencially-disposed portion 46 of the lid perimeter upwardly-and-downwardly-extending and circumferencially-disposed rim 44 of the removable, resealable, and generally circular-shaped lid 14 of the first stackable spill proof paint can 10 preventing lateral movement thereof. The stacking procedure, supra, can be repeated to stack any number of stackable spill proof paint cans 10 desired.

It will be understood that each of the elements described above, or two or more together, may also find a useful application in other types of constructions differing from the types described above.

While the invention has been illustrated and described as embodied in a stackable spill proof paint can, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A stackable spill proof paint can, comprising:

a) a hollow, partially opened-top, closed-bottom, and generally cylindrically-shaped container having a partially opened-top with a perimeter and an outer surface, and a closed bottom; said partially opened-top of said hollow, partially opened-top, closed-bottom, and generally cylindrically-shaped container having a through aperture with a shape, and a ledge, so that excess paint can be wiped off from a paint brush that was previously dipped into paint contained in said hollow, partially opened-top, closed-bottom, and generally cylindrically-shaped container; said through aperture of said partially opened-top of said hollow, partially opened-top, closed-bottom, and generally cylindrically-shaped container being a substantially D-shaped through aperture with a straight side and an arcuate side;

b) a removable, resealable, and generally circular-shaped lid having a generally circular-shaped main portion with a perimeter and a depression; said depression of said generally circular-shaped main portion of said removable, resealable, and generally circular-shaped lid having a depth, a through aperture, and a shape substantially equivalent to said shape of said through aperture of said partially opened-top of said hollow, partially opened-top, closed-bottom, and generally cylindrically-shaped container, so that when said removable, resealable, and generally circular-shaped lid is placed on said partially opened-top of said hollow, partially opened-top, closed-bottom, and generally cylindrically-shaped container said depression of said generally circular-shaped main portion of said removable, resealable, and generally circular-shaped lid enters said through aperture of said partially opened-top of said hollow, partially opened-top, closed-bottom, and generally cylindrically-shaped container and prevents relative rotation between said removable, resealable, and generally circular-shaped lid and said hollow, partially opened-top, closed-bottom, and generally cylindrically-shaped container while providing a seal therebetween; and c) a pouring spout disposed in said depression of said generally circular-shaped main portion of said removable, resealable, and generally circular-shaped lid and being in fluid communication with said through aperture of said depression of said generally circular-shaped main portion of said removable, resealable, and generally circular-shaped lid, so that the paint contained in said hollow, partially opened-top, closed-bottom, and generally cylindrically-shaped container can be readily poured therefrom.

2. The can as defined in claim 1, wherein said hollow, partially opened-top, closed-bottom, and generally cylindrically-shaped container, said removable, resealable, and generally circular-shaped lid, and said pouring spout are plastic, so that they will not rust during storage of left over paint and said removable, resealable, and generally circular-shaped lid can be used to mix paint colors.

3. The can as defined in claim 1, wherein said ledge of said partially opened-top of said hollow, partially opened-top, closed-bottom, and generally cylindrically-shaped container is a substantially D-shaped ledge formed by said straight side of said substantially D-shaped through aperture of said partially opened-top of said hollow, partially opened-top, closed-bottom, and generally cylindrically-shaped container and an intersecting part of said perimeter of said partially opened-top of said hollow, partially opened-top, closed-bottom, and generally cylindrically-shaped container.

4. The can as defined in claim 1; further comprising a circumferencially-disposed and upwardly-extending bead that surrounds and extends upwardly from said perimeter of said partially opened-top of said partially opened-top, closed-bottom, and generally cylindrically-shaped container, so that yet an additional seal is provided between said removable, resealable, and generally circular-shaped lid and said partially opened-top, closed-bottom, and generally cylindrically-shaped container.

5. The can as defined in claim 1; further comprising a pivotally mounted and substantially semi-circular-shaped carrying handle with ends that are pivotally mounted to said partially opened-top, closed-bottom, and generally cylindrically-shaped container, so that carrying said stackable spill proof paint can is facilitated.

6. The can as defined in claim 1, wherein said removable, resealable, and generally circular-shaped lid further has an upwardly-and-downwardly-extending and circumferencially-disposed rim that extends upwardly and downwardly from said perimeter of said generally circular-shaped main portion of said removable, resealable, and generally circular-shaped lid.

7. The can as defined in claim 6, wherein said upwardly-and-downwardly-extending and circumferencially-disposed rim of said removable, resealable, and generally circular-shaped lid has an upwardly-extending and circumferencially-disposed portion that extends upwardly from said perimeter of said generally circular-shaped main portion of said removable, resealable, and generally circular-shaped lid and together with said generally circular-shaped main portion of said removable, resealable, and generally circular-shaped lid forms a receptacle, so that said closed bottom of said hollow, partially opened-top, closed-bottom, and generally cylindrically-shaped container of a second said stackable spill proof paint can be positioned in said receptacle of said removable, resealable, and generally circular-shaped lid of a first said stackable spill proof paint can with said upwardly-extending and circumferencially-disposed portion of said upwardly-and-downwardly-extending and circumferencially-disposed rim of said removable, resealable, and generally circular-shaped lid of said first said stackable spill proof paint can preventing lateral movement of said second said stackable spill proof paint can.

8. The can as defined in claim 7, wherein said upwardly-and-downwardly-extending and circumferencially-disposed rim of said removable, resealable, and generally circular-shaped lid further has a downwardly-extending and circumferencially-disposed portion that extends downwardly from said perimeter of said generally circular-shaped main portion of said removable, resealable, and generally circular-shaped lid and is in substantial alignment with said upwardly-extending and circumferencially-disposed portion of said upwardly-and-downwardly-extending and circumferencially-disposed rim of said removable, resealable, and generally circular-shaped lid and is positioned adjacent to said outer surface of said perimeter of said partially opened-top of said hollow, partially opened-top, closed-bottom, and generally cylindrically-shaped container, so that yet an additional seal is provided between said removable, resealable, and generally circular-shaped lid and said partially opened-top, closed-bottom, and generally cylindrically-shaped container.

9. The can as defined in claim 1, wherein said depression of said generally circular-shaped main portion of said removable, resealable, and generally circular-shaped lid is a substantially D-shaped and downwardly-extending depression; said D-shaped and downwardly-extending depression of said generally circular-shaped main portion of said removable, resealable, and generally circular-shaped lid has a straight side and an arcuate side with a substantial midpoint.

10. The can as defined in claim 9, wherein said arcuate side of said substantially D-shaped and downwardly-extending depression of said generally circular-shaped main portion of said removable, resealable, and generally circular-shaped lid is substantially parallel to and disposed slightly inward of said perimeter of said generally circular-shaped main portion of said removable, resealable, and generally circular-shaped lid.

11. The can as defined in claim 9, wherein said substantially D-shaped and downwardly-extending depression of said generally circular-shaped main portion of said removable, resealable, and generally circular-shaped lid has a through aperture.

12. The can as defined in claim 11; wherein said through aperture of said substantially D-shaped and downwardly-extending depression of said generally circular-shaped main portion of said removable, resealable, and generally circular-shaped lid is disposed slightly inward of said substantial midpoint of said arcuate side of said substantially D-shaped and downwardly-extending depression of said generally circular-shaped main portion of said removable, resealable, and generally circular-shaped lid and in proximity to said perimeter of said generally circular-shaped main portion of said removable, resealable, and generally circular-shaped lid.

13. The can as defined in claim 11, wherein said pouring spout is a bellowed, collapsible, and pop-up pouring spout that has an open narrow free distal end and an open wide proximal end that is wider than said open narrow free distal end of said bellowed, collapsible, and pop-up pouring spout and is sealing secured in said aperture of said substantially D-shaped and downwardly-extending depression of said generally circular-shaped main portion of said removable, resealable, and generally circular-shaped lid while being in fluid communication therewith.

14. The can as defined in claim 13, wherein said bellowed, collapsible, and pop-up pouring spout is collapsible to a height no greater than said depth of said depression of said generally circular-shaped main portion of said removable, resealable, and generally circular-shaped lid, so that when said bellowed, collapsible, and pop-up pouring spout is collapsed into said depression of said generally circular-shaped main portion of said removable, resealable, and generally circular-shaped lid, said closed bottom of said hollow, partially opened-top, closed-bottom, and generally cylindrically-shaped container of a second said stackable spill proof paint can be positioned on said removable, resealable, and generally circular-shaped lid of a first said stackable spill proof paint can.

15. The can as defined in claim 13; further comprising a cap for selectively opening and closing said open narrow free distal end of said bellowed, collapsible, and pop-up pouring spout.

* * * * *